US011261871B2

(12) United States Patent
Pirouzpanah et al.

(10) Patent No.: US 11,261,871 B2
(45) Date of Patent: Mar. 1, 2022

(54) DUAL STAGE BLOWER ASSEMBLY

(71) Applicant: Regal Beloit America, Inc., Beloit, WI (US)

(72) Inventors: Sahand Pirouzpanah, Miamisburg, OH (US); Joseph A. Henry, Dayton, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 67 days.

(21) Appl. No.: 16/714,049

(22) Filed: Dec. 13, 2019

(65) Prior Publication Data

US 2020/0191150 A1 Jun. 18, 2020

Related U.S. Application Data

(60) Provisional application No. 62/779,245, filed on Dec. 13, 2018.

(51) Int. Cl.

| | |
|---|---|
| ***F04D 29/28*** | (2006.01) |
| ***F04D 17/12*** | (2006.01) |
| ***F04D 25/16*** | (2006.01) |
| ***F04D 29/30*** | (2006.01) |

(52) U.S. Cl.

CPC ..... *F04D 17/12* (2013.01); *F04D 25/163* (2013.01); *F04D 25/166* (2013.01); *F04D 29/281* (2013.01); *F04D 29/30* (2013.01); *F05D 2260/4031* (2013.01)

(58) Field of Classification Search

CPC ..... F04D 17/12; F04D 17/164; F04D 16/163; F04D 25/166; F04D 29/281; F04D 29/282; F04D 29/30; F05D 2260/4031

See application file for complete search history.

(56) References Cited

U.S. PATENT DOCUMENTS 2,228,425 A * 1/1941 Venderbush ..... B01D 45/14 96/282
3,124,301 A * 3/1964 Helmbold ..... F04D 17/04 415/53.2

(Continued)

FOREIGN PATENT DOCUMENTS

| | | |
|---|---|---|
| JP | 2008169725 A | 7/2008 |
| WO | 2012012547 A1 | 1/2012 |
| WO | 2015051396 A1 | 4/2015 |

OTHER PUBLICATIONS

PCT International Search Report and Written Opinion for Application PCT/US2019/066360 dated Mar. 2, 2020; 9 pp.

*Primary Examiner* — Ninh H. Nguyen
(74) *Attorney, Agent, or Firm* — Armstrong Teasdale LLP

(57) ABSTRACT

A dual stage blower assembly includes a first fan configured to rotate about the rotational axis and including a first plurality blades. The first plurality of blades include a plurality of backward curved blades. The dual stage blower assembly also includes a second fan circumscribing the first fan and configured to rotate about the rotational axis. The second fan includes a second plurality of blades, wherein the second plurality of blades include one of a plurality of forward curved blades, a plurality of a radial blades, or a plurality of backward curved blades. At least one motor is coupled to the first fan and the second fan and configured to rotate the first fan and the second fan about the rotational axis.

18 Claims, 4 Drawing Sheets

(56) References Cited

U.S. PATENT DOCUMENTS

| | | | | |
|---|---|---|---|---|
| 4,946,348 | A * | 8/1990 | Yapp | F04D 29/5826 415/211.2 |
| 6,960,059 | B2 * | 11/2005 | Chang | F04D 17/127 415/65 |
| 7,435,051 | B2 | 10/2008 | Obinelo et al. | |
| 8,734,087 | B2 | 5/2014 | Converse | |
| 9,086,073 | B2 | 7/2015 | Iyer et al. | |
| 9,976,558 | B2 * | 5/2018 | Yang | F04D 17/04 |
| 2005/0163614 | A1 | 7/2005 | Chapman | |
| 2011/0318175 | A1 | 12/2011 | Converse | |
| 2014/0105734 | A1 | 4/2014 | Kato et al. | |

* cited by examiner

DUAL STAGE BLOWER ASSEMBLY

CROSS-REFERENCE TO RELATED APPLICATION

This application claims priority to U.S. Provisional Patent Application Ser. No. 62/779,245 filed Dec. 13, 2018 for DUAL STAGE BLOWER ASSEMBLY, which is hereby incorporated by reference in its entirety.

BACKGROUND OF THE INVENTION

The embodiments described herein relate generally to blower assemblies, and more particularly, to dual stage blower assemblies for use in forced air or air circulating systems.

Many known residential and commercial forced air, heating and air conditioning distribution systems require air propulsion units. In addition to providing movement of air for heating and cooling systems, air propulsion units are often used in combination with condenser units or to supplement other heat transfer operations. Some known air propulsion units are motor driven fans. These fans may be, for example, a plenum wheel driven by an electric motor.

At least some known blower assemblies include a plug fan with a plurality of circumferentially-spaced backward curved blades that are rotated by a motor to intake an airflow in an axial direction and exhaust the airflow in a radial direction. Generally, such backward curved fans are efficient to operate. However, they also rotate at a relatively high speed, which may produce an undesirable level of noise, especially in residential applications.

Other known blower assemblies include an impeller wheel with a plurality of circumferentially-spaced forward curved blades that are rotated by a motor to intake an airflow in an axial direction and exhaust the airflow in a radial direction. Generally, such forward curved fans rotate at a lower speed, and thus produce less noise, than backward curved fans. However, at least some forward curved fans may be less efficient to operate than backward curved fans.

BRIEF DESCRIPTION OF THE INVENTION

In one aspect, a dual stage blower assembly is provided. The dual stage blower assembly includes a first fan configured to rotate about the rotational axis and including a first plurality blades. The first plurality of blades include a plurality of backward curved blades. The dual stage blower assembly also includes a second fan circumscribing the first fan and configured to rotate about the rotational axis. The second fan includes a second plurality of blades, wherein the second plurality of blades include one of a plurality of forward curved blades, a plurality of a radial blades, or a plurality of backward curved blades. At least one motor is coupled to the first fan and the second fan and configured to rotate the first fan and the second fan about the rotational axis.

In another aspect, a method of assembling a dual stage blower assembly having a rotational axis is provided. The method includes providing a first fan configured to rotate about the rotational axis and including a first plurality blades, wherein the first plurality of blades include a plurality of backward curved blades. The method also includes positioning a second fan about the first fan such that the second fan circumscribes the first fan. The second fan includes a second plurality of blades that include one of a plurality of forward curved blades, a plurality of a radial blades, or a plurality of backward curved blades. The method also includes coupling at least one motor to the first fan and to the second fan such that the at least one motor causes the first fan and the second fan to rotate about the rotational axis.

DETAILED DESCRIPTION OF THE INVENTION

The present disclosure provides an exemplary dual stage blower assembly that includes a first fan configured to rotate about the rotational axis and including a first plurality of backward curved blades. A second fan circumscribes the first fan and is also configured to rotate about the rotational axis. The second fan includes a second plurality of blades that are either forward curved blades, radial blades, or backward curved blades. At least one motor is coupled to the first fan and the second fan and configured to rotate the first fan and the second fan about the rotational axis.

In such a configuration, the first fan rotates at a first speed and the second fan rotates at a second speed that is slower than the first speed. Both the first and second speeds are slower than conventional rotational speeds of single fan blower assemblies, but generate a similar air flow rate and static pressure as conventional single fan blower assemblies. Because of the slower rotational speed, the dual stage blower assembly described herein generates less noise than known conventional backward single fan blower assemblies. Additionally, the lower rotational speeds also increase the efficiency of the dual stage blower assembly described herein. Furthermore, the configuration of the dual stage blower assembly described herein allows for the use of smaller size fans to generate the same performance specifications (flow rate, static pressure, and efficiency) as larger, single fan blower assemblies.

Figure 1:
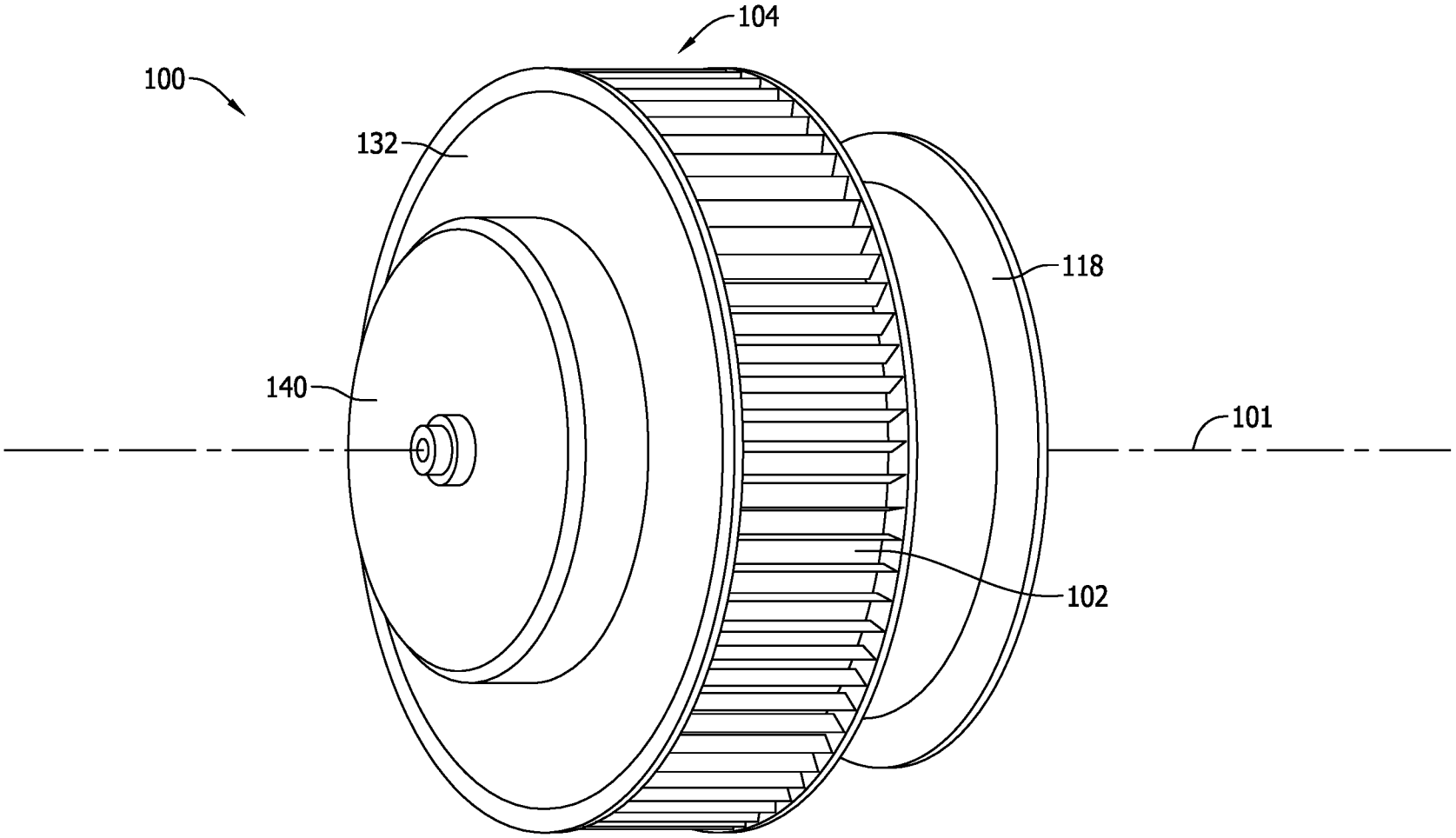
FIG. 1 is a perspective view of an exemplary blower assembly.
Figure 2:
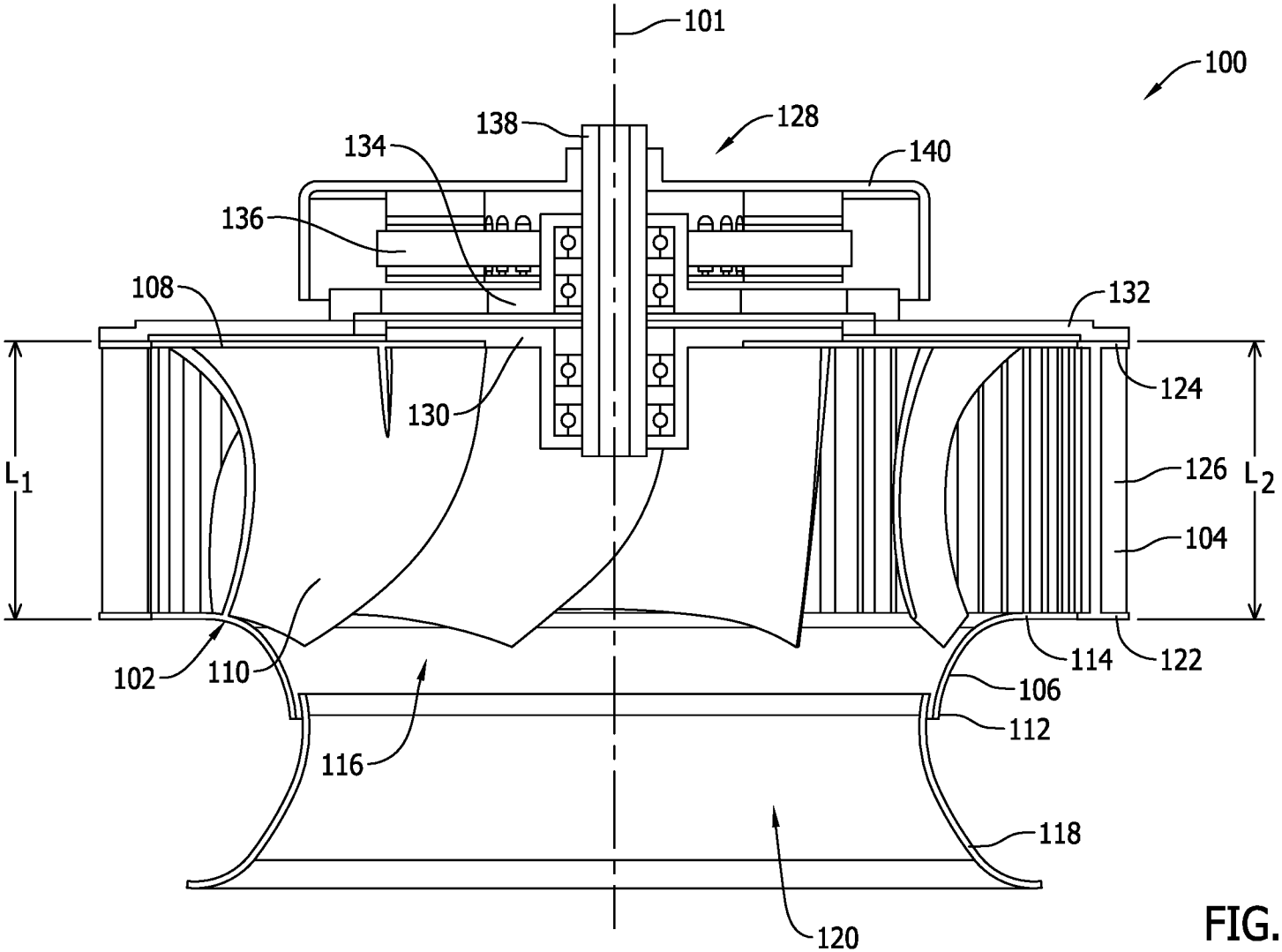
FIG. 2 is a side cross-sectional view of the blower assembly shown in FIG. 1.
Figure 3:
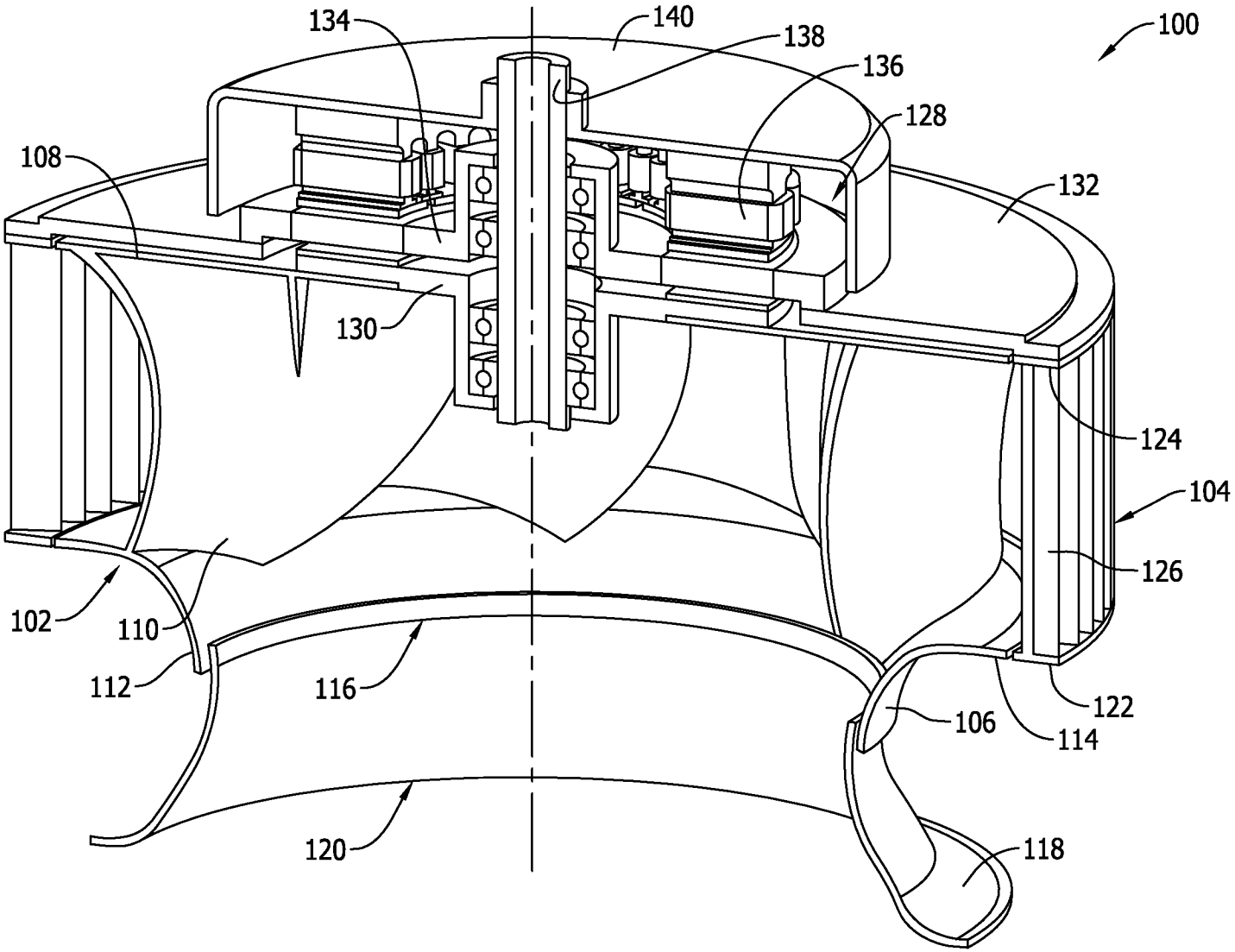
FIG. 3 is a side perspective cross-sectional perspective view of the blower assembly shown in FIG. 1.
Figure 4:
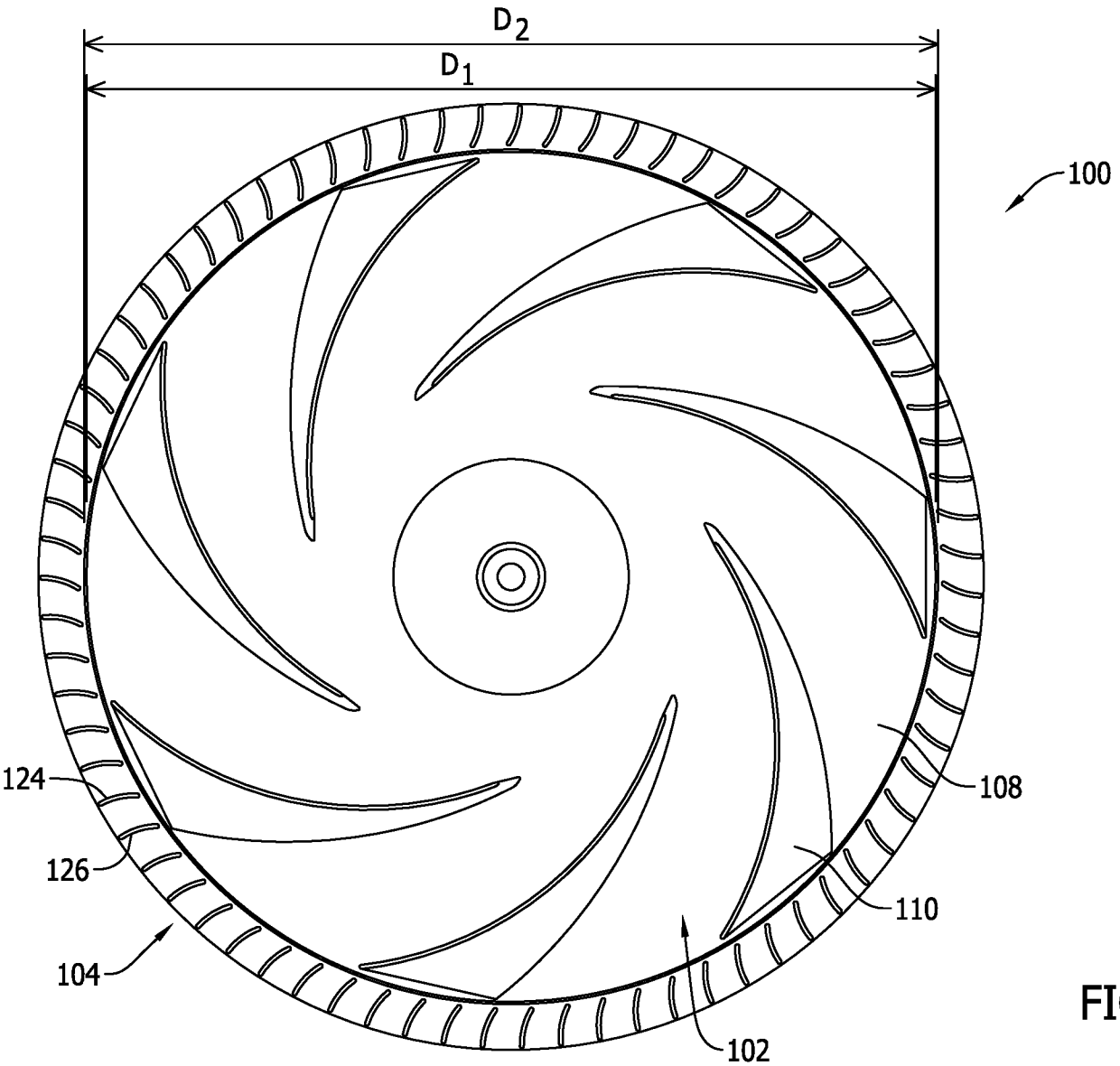
FIG. 4 is a bottom cross-sectional view of the blower assembly shown in FIG. 1.

FIG. 1 is a perspective view of a dual stage blower assembly 100. FIG. 2 is a side cross-sectional view of blower assembly 100 illustrating a first fan 102 and a second fan 104. FIG. 3 is a side perspective cross-sectional perspective view of blower assembly 100 with first fan 102 and second fan 104. FIG. 4 is a bottom cross-sectional view of the blower assembly blower assembly 100 with first fan 102 and second fan 104.

In this embodiment, blower assembly 100 is configured to produce a flow of air for a forced air system, e.g., a commercial or industrial HVAC system. Blower assembly 100 includes a first fan 102 and a coaxial second fan 104 that rotate about a common rotational axis 101. In the exemplary embodiment, as described in further detail herein, second fan 104 circumscribes first fan 102 and rotates a slower speed (lower RPM) than does first fan 102. As shown in FIGS. 1-4, first fan 102 includes a front plate 106, a rear plate 108, and a plurality of blades 110 extending axially between front plate 106 and rear plate 108. In the exemplary implementation, plurality of blades 110 are backward curved, that is, curved in the opposite direction of rotation of first fan 102. Specifically, in the exemplary embodiment, first fan 102 is a backward curved plug fan. Blades 110 are attached to rear plate 108 and/or front plate 106 such that each blade 110 extends between rear plate 108 and front plate 106. In one embodiment, each blade 110 is attached to rear plate 108 and/or front plate 106 via features formed in rear plate 108 and/or front plate 106 such as an opening, e.g., a groove or a slot, configured to restrict an amount of movement of blade 110 between rear plate 108 and front plate 106 while permitting blades 110 to operate as described herein. In another embodiment, blades 110 are integrally formed with rear plate 108 and/or front plate 106. Generally, blades 110 are coupled to rear plate 108 and/or front plate 106 in any manner that permits first fan 102 to operate as described herein.

In the exemplary embodiment, rear plate 108 is substantially planar and is oriented perpendicular to axis 101. Additionally, rear plate 108 defines an outer diameter D1 (shown in FIG. 4) of first fan 102. Front plate 106 includes a radially inner curved portion 112 and a radially outer planar portion 114. A first axial length L1 is defined between rear plate 108 and planar portion 114 of front plate 106 and represents the axial length of first fan 102. Curved portion 112 defines an inlet 116 to first fan 102 and second fan 104. During rotation, blades 110 are configured to pull in air along axis 101 through inlet 116 and eject the air radially outward through outlets located between adjacent blades 110.

Blower assembly 100 also includes an inlet ring 118 positioned upstream of front plate 106. In the exemplary embodiment, inlet ring 118 defines an inlet 120 to blower assembly 100 through which air passes before passing through fan inlet 116.

As best shown in FIGS. 2-4, second fan 104 is an impeller wheel that circumscribes first fan 102 and also rotates about axis 101, as described herein. In the exemplary embodiment, second fan 104 includes a first end ring 122, a second end ring 124, and a plurality of blades 126 that are coupled between first end ring 122 and second end ring 124. Blades 126 may be attached to first end ring 122 and second end ring 124 in any manner that permits second fan 104 to operate as described herein. As shown in FIG. 4, end rings 122 and 124 define an inner diameter D2 of second fan 104. In the exemplary embodiment, inner diameter D2 is substantially similar to out diameter D1 of first fan 102. Specifically, inner diameter D2 and outer diameter D1 are designed to be as close as possible without allowing first fan 102 to contact second fan 104.

Second fan 104 includes an axial length L2 defined between first end ring 122 and second end ring 124. In one embodiment, axial length L2 of second fan 104 is substantially similar to axial length L1 of first fan 102. In another embodiment, axial length L2 of second fan 104 is longer than axial length L1 of first fan 102. In embodiments, wherein the second axial length L2 of second fan 104 is substantially similar to the first axial length L1 of first fan 102, first and second fans 102 and 104 are axially aligned. More specifically, planar portion 114 of front plate 106 of first fan 102 is axially aligned with first end ring 122 of second fan 104. Additionally, rear plate 108 of first fan 102 is axially aligned with second end ring 124 of second fan 104. In embodiments, where axial lengths L1 and L2 are different, only one set of rear plate 106 and second end ring 124 or planar portion 114 and first end ring 122 are axially aligned. In another embodiment, first and second fans 102 and 104 are not axially aligned such that planar portion 114 is axially offset from first end ring 122, and rear plate 108 is axially offset from second end ring 124.

In the exemplary embodiment, blades 126 of second fan 104 are one of either forward curved blades that slightly curve in the direction of rotation of second fan 104, or radially oriented blades at the trailing edge of the blade, or backward curved blades that slightly curve in the opposite direction of rotation of second fan 104. In either embodiment, second fan 104 includes a larger number of blades 126 in case the blade chord length in the second fan 104 is shorter than the blade length in the first fan 102. For example, second fan 104 includes between $1 \cdot OD_2/(OD_2-D_2)$ and $1.2 \cdot OD_2/(OD_2-D_2)$ blades where $OD_2$ is the outer diameter of the second fan 104. The larger number of blades serves to optimally guide the flow in the flow passage with higher curvature.

Additionally, in embodiments wherein second fan 104 includes forward curved blades 126, the curvature of blades 126 is less than the curvature of conventional forward curved blades. For example, the curvature of blades 126 is within a range of approximately 30 degrees and approximately 60 degrees. Blades 126 have a smaller curvature because to reach the desired pressure rise across fans, the airflow entering blades 126 has already been turned by first fan 102 and so blades 126 do not need to redirect the angle of the airflow as much to cause the airflow to exit the second fan at a desired angle as it would if first fan 102 had not already partially redirected the flow.

In the exemplary embodiment, blower assembly 100 also includes at least one motor 128 coupled to first fan 102 and second fan 104 and configured to rotate first fan 102 and second fan 104 about axis 101. Specifically, motor 128 is coupled to rear plate 108 of first fan 102. More specifically, motor 128 includes a first rotor assembly 130 coupled to rear plate 108. Additionally, motor 128 includes a mounting plate 132 coupled second end ring 124 and a second rotor assembly 134 coupled to mounting plate 132. A stator assembly 136 of motor 128 is coupled to at least one of first and second rotor assembly 130 and 134, and, in the exemplary embodiment, controls rotation of first and second rotor assembly 130 and 134. Motor 128 also includes a central shaft 138 extending along axis 101 and coupled to stator assembly 136 and first and second rotor assemblies 130 and 134. A cap 140 is coupled to shaft 138 and extends over and around motor 128 to rear plate 108 to protect motor 128 components.

In the exemplary embodiment, motor 128 is a combined axial flux electric motors. Alternatively, motor 128 is a combined radial flux electric motors. In one embodiment, blower assembly 100 includes a pair of motors 128 that each rotate one of first fan 102 or second fan 104. Additionally, motor 128 includes a magnetic or mechanical gear system that enables operation of blower assembly 100 as described herein. Generally, blower assembly 100 includes any type of motor configuration that facilitates operation of first and second fans 102 and 104.

During operation, air enters blower assembly 100 through inlet 120 defined by inlet ring 118 and continues through inlet 116 in front plate 106 of first fan 104. Motor 128 causes rotation of first fan at a first rotation speed to draw the air into first fan 102. The air entering via inlet 116 is deflected radially outward from central axis 101 toward backward curved blades 110. Blades 110 are configured to pull the air through inlet 116 into a central chamber of first fan 102. The air passes through channels between blades 110 and exits first fan 102 in a direction that matches with the blade 126 angles. Immediately thereafter, the airflow enters second fan 104, which is also rotating. More specifically, second fan is rotating at a second rotational speed that is slower than the first rotation speed at which first fan 102 is rotating. The airflow enters forward curved, radial blades, or backward blades 126 and is channeled outward from second fan 104.

In the exemplary embodiment, motor 128 rotates first fan 102 in a rotation direction at a first speed and rotates second fan 104 in the same rotation direction at a second speed slower than the first speed. More specifically, motor 128 rotates at approximately 2,000 revolutions per minute (rpm), and second fan 104 rotates at approximately 1,400 rpm. Conventional backward blower assemblies having only a single fan rotate at speeds of approximately 2,500 rpm. As such, blower assembly 100 includes two fans 102 and 104 that both rotate slower than a convention fan, but that generate a substantially similar flow rate and static pressure as a single fan blower assembly. Rotating fans 102 and 104 a slower speeds reduces the noise level generated by the fan. Accordingly, blower assembly 100 generates less noise because of the lower rotational speed of fans 102 and 104. Additionally, the lower rotation speeds also increase the efficiency of blower assembly 100. So blower assembly 100, having fans 102 and 104 reduces the noise levels and increases efficiency when compared with some conventional blower assemblies. Furthermore, the configuration of blower assembly 100 allows for the use of smaller size fans to generate the same performance specifications (flow rate, static pressure, and efficiency) as larger, single fan blower assemblies.

The present disclosure provides an exemplary dual stage blower assembly that includes a first fan configured to rotate about the rotational axis and including a first plurality of backward curved blades. A second fan circumscribes the first fan and is also configured to rotate about the rotational axis. The second fan includes a second plurality of blades that are either forward curved blades, radial blades, or backward curved blades. At least one motor is coupled to the first fan and the second fan and configured to rotate the first fan and the second fan about the rotational axis.

In such a configuration, the first fan rotates at a first speed and the second fan rotates at a second speed that is slower than the first speed. Both the first and second speeds are slower than conventional rotational speeds of single fan blower assemblies, but generate a similar air flow rate and static pressure as conventional single fan blower assemblies. Because of the slower rotational speed, the dual stage blower assembly described herein generates less noise than known backward conventional single fan blower assemblies. Additionally, the lower rotational speeds also increase the efficiency of the dual stage blower assembly described herein. Furthermore, the configuration of the dual stage blower assembly described herein allows for the use of smaller size fans to generate the same performance specifications (flow rate, static pressure, and efficiency) as larger, single fan blower assemblies.

The embodiments described herein relate to a blower assembly and methods of assembling the same. More specifically, the embodiments relate to a blower assembly that includes a first fan and a second fan circumscribing the first fan. The methods and apparatus are not limited to the specific embodiments described herein, but rather, components of apparatus and/or steps of the methods may be utilized independently and separately from other components and/or steps described herein. For example, the methods may also be used in combination with a forward inclined fan or blower assembly or a radial flux electric motor, and are not limited to practice with only the backward curved fan and axial flux motor as described herein. In addition, the exemplary embodiment can be implemented and utilized in connection with many other HVAC applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dual stage blower assembly comprising a rotational axis, said dual stage blower assembly comprising:

a first fan configured to rotate about said rotational axis and comprising a first plurality blades, wherein said first plurality of blades comprise a plurality of backward curved blades, and wherein said first fan defines a central chamber, wherein said first fan comprises a backward curved plug fan comprising a front plate and a rear plate, wherein said first plurality of blades extend axially between said front plate and said rear plate; and a second fan circumscribing said first fan and configured to rotate about said rotational axis, wherein said second fan comprises a second plurality of blades, wherein said second plurality of blades comprise one of a plurality of forward curved blades, a plurality of a radial blades, or a plurality of backward curved blades;

at least one motor coupled to said first fan and said second fan and configured to rotate said first fan and said second fan about the rotational axis, wherein said at least one motor is positioned outside said central chamber.

2. The dual stage blower assembly in accordance with claim 1, wherein said front plate defines an air inlet and said rear plate is coupled to said motor.

3. The dual stage blower assembly in accordance with claim 1, wherein said second fan comprises an impeller wheel comprising a first end ring and a second end ring, wherein said second plurality of blades extend axially between said first end ring and said second end ring.

4. The dual stage blower assembly in accordance with claim 3, wherein said rear plate is axially aligned with said second end ring.

5. The dual stage blower assembly in accordance with claim 3, wherein said front plate is axially aligned with said first end ring.

6. The dual stage blower assembly in accordance with claim 1, wherein said first fan defines a first axial length and said second fan defines a second axial length substantially similar to the first axial length.

7. The dual stage blower assembly in accordance with claim 1, wherein said first fan defines a first axial length and said second fan defines a second axial length longer than the first axial length.

8. The dual stage blower assembly in accordance with claim 1, wherein said at least one motor comprises a mounting plate coupled to said second fan.

9. The dual stage blower assembly in accordance with claim 1, wherein said first fan comprises an outer diameter, and wherein said second fan comprises an inner diameter substantially similar to the first diameter.

10. The dual stage blower assembly in accordance with claim 1, wherein said at least one motor comprises one of an axial flux electric motor or a radial flux electric motor.

11. The dual stage blower assembly in accordance with claim 1, wherein said at least one motor comprises a gear system.

12. The dual stage blower assembly in accordance with claim 1, wherein said at least one motor is configured to rotate said first fan at a first speed and configured to rotate said second fan a second speed.

13. The dual stage blower assembly in accordance with claim 12, wherein the second speed is lower than the first speed.

14. A method of assembling a dual stage blower assembly having a rotational axis, said method comprising:

providing a first fan configured to rotate about the rotational axis and including a first plurality blades, wherein the first plurality of blades include a plurality of backward curved blades, and wherein the first fan defines a central chamber;

positioning a second fan about the first fan such that the second fan circumscribes the first fan, wherein the second fan includes a second plurality of blades, wherein the second plurality of blades include one of a plurality of forward curved blades, a plurality of a radial blades, or a plurality of backward curved blades, wherein positioning the second fan about the first fan comprises positioning the second fan about the first fan such that the first fan and the second fan are axially aligned;

coupling at least one motor to the first fan and to the second fan such that the at least one motor causes the first fan and the second fan to rotate about the rotational axis, wherein the at least one motor is positioned outside the central chamber.

15. The method in accordance with claim 14, wherein coupling the at least one motor to the first fan and to the second fan comprises coupling the at least one motor to the first fan and to the second fan such that the at least one motor is configured to rotate the first fan at a first speed and configured to rotate the second fan a second speed.

16. The method in accordance with claim 15, wherein the second speed is lower than the first speed.

17. The method in accordance with claim 14, wherein positioning the second fan about the first fan comprises positioning the second fan about the first fan such that a front plate of the first fan is axially aligned with a first end ring of the second fan.

18. The method in accordance with claim 17, wherein positioning the second fan about the first fan comprises positioning the second fan about the first fan such that a rear plate of the first fan is axially aligned with a second end ring of the second fan.

* * * * *